US006047595A

United States Patent [19]

Herron et al.

[11] Patent Number: 6,047,595

[45] Date of Patent: Apr. 11, 2000

[54] METHOD OF DETERMINING THE PERMEABILITY OF SEDIMENTARY STRATA USING NMR DATA

[75] Inventors: Michael M. Herron; Christian Straley, both of Ridgefield, Conn.

[73] Assignee: Schlumberger Technology Corporation, Ridgefield, Conn.

[21] Appl. No.: 08/989,307

[22] Filed: Dec. 12, 1997

[51] Int. Cl.[7] ..... E21B 49/00

[52] U.S. Cl. ..... 73/152.05

[58] Field of Search ..... 73/152.05; 364/422; 250/256

[56] References Cited

U.S. PATENT DOCUMENTS 4,420,975 12/1983 Nagel et al. ..... 73/155
5,156,205 10/1992 Prasad ..... 166/250

OTHER PUBLICATIONS

Johnson, D.L., Koplik, J. and Schwartz, L.M., "New Pore–size Parameter Characterizing Transport in Porous Media", Physical Review Letters, (1986), 57, 2564–2567.

Carman, P.C., "Flow of Gases Through Porous Media", (1956), Academic Press–Inc., p. 12–33.

vanOlphen, H. and Fripiat, J.J., "Data Handbook for Clay Minerals and Other Non–metallic Minerals", Pergamon Press, p. 346.

Herron, M.M. "Permeability Estimation", The Search for Oil & Gas in Latin America & the Caribbean, Schlumberger Surenco C.A., Caracas (1995), 2, 44–45.

Bryant, I. et al, "Bachaquero Bloque IV: A Blessing in Disguise", The Search for Oil & Gas in Latin America & the Caribbean, Schlumberger Surenco C.A., Caracas (1995), 2, 33–61.

Herron, S.L. and Herron, M.M., "Quantitative Lithology: An Application for Open Cased Hole Spectroscopy", Transactions of the 37th Annual Logging Symposium, SPWLA, Paper E, p. 14.

Herron, S.L., Chiaramonte, J.M. and Herron, M.M., "Effect of Modifying Element Mineral Transforms on Geochemical Log Interpretation", Nuclear Geophysics (1994), 8(5), 411–432.

Wendlandt, R.F. and Bhuyan, K., "Estimation of Mineralogy and Lithology from Geochemical Log Measurements", American Association of Petroleum Geologists Bulletin, (1990), 74, 837–856.

D. Marion, A. Nur, and F. Alabert, "Modeling the Relationships Between Sonic Velocity, Porosity, Permeability, and Shaliness in Sand, Shale, and Shaley Sand", SPWLA Thirteenth Annual Logging Symposium, Jun. 11–14, 1989.

Sen, P.N., Straley, C., Kenyon, W.E. and Whittingham, M.S., "Surface–to–Volume Ratio, Charge Density, Nuclear Magnetic Relaxation and Permeability in Clay–Bearing Sandstones", Geophysics, (1990), 55, 61–69.

Nelson, P.H., "Permeability–porosity Relationships in Sedimentary Rocks", Log Analyst, (1994) 35, 38–62.

(List continued on next page.)

*Primary Examiner*—Benjamin R. Fuller
*Assistant Examiner*—Jewel V. Thompson
*Attorney, Agent, or Firm*—William B. Batzer; Mark Levy

[57] ABSTRACT

There is provided a method of accurately estimating the permeability of sedimentary rock formations from well logging data. The method involves a short relaxation time strategy with the identification of the key k-Lambda parameter $S/V_p$, which is the surface-to-pore ratio. The inverse of $T_2$ is related to this ratio by the surface relaxivity, ρ2. The k-Lambda estimator is given by:

$$\frac{S}{V_p} = \frac{1}{V_p}\sum_{i}^{n}\frac{\Delta V_i}{\rho_{2i} T_{2i}}$$

where: $\Delta V_1$ represents the volume elements of the $T_2$ distribution and the sum over i=1 to n represents some set of early to later volume elements; and $V_p$ is the total pore volume.

2 Claims, 1 Drawing Sheet

OTHER PUBLICATIONS

Braynt, S., Cade, C. and Mellor, D., "Permeability Prediction from Geologic Models", American Association of Petroleum Geologists Bulletin, (1993), 77, 1338–1350.

Kenyon, W.E., "Nuclear Magnetic Resonance as a Petrophysical Measurement", Nuclear Geophysics, (1992), 6, 153–171.

Bryant, I.D., Baygun, B., Herron, M.M., Mattson, A., Ramamoorthy, R., Stewart, L., Tariq, S.M., Coll, M.C., Cordova, P., Gamero de Villarroel, H., Hernandez, L., Jiminez, Z., Leon, K. and Rondon, L., "Integration of Old and New Measurements to Optimize Redevelopment of the Lower Lagunillas Reservoir of Bloque IV, Lake Maracaibo, Venezuela", paper SPE 36096 Apr. 23–26, 1996.

Doyen, P.M., "Permeability, Conductivity, and Pore Geometry of Sandstone", Journal of Geophysical Research, (1988), 93, 7729–7740.

Paterson, M.S., "The Equivalent Channel Model for Permeability and Resistivity in Fluid Saturated Rock–a Reappraisal", Mechanics of Materials, (1983), 2, 345–351.

Bourbie, T. and Zinszner, B., "Hydraulic and Acoustic Properties as a Function of Porosity in Founfainebleau Sandstone", Journal of Geophysical Research, (1985), 90, 11524–11532.

Katz, A.J. and Thompson, A.H., "Quantitative Prediction of Permeability in Porous Rock", Physical Review B,(1986), 34, 8179–8181.

METHOD OF DETERMINING THE PERMEABILITY OF SEDIMENTARY STRATA USING NMR DATA

RELATED PATENT APPLICATION

This application is related to copending application, Ser. No. 08/989307 (Attorney Docket No. 60.1298); filed herewith, for METHOD OF DETERMINING THE PERMEABILITY OF SEDIMENTARY STRATA, the teachings of which are hereby incorporated by reference.

FIELD OF THE INVENTION

The invention relates to well logging procedures and, more particularly, to an improved method of determining the permeability of sedimentary and certain carbonate rock using a permeability estimator constructed from the k-Lambda model and the short time spin echoes of NMR data.

BACKGROUND OF THE INVENTION

Over the last several decades, well logging methods have become very sophisticated. Many new procedures, such as nuclear magnetic resonance (NMR), have been used in the testing of well strata. NMR methods have proven useful in determining whether a particular well will be productive. Producible fluids (hydrocarbons) are easily distinguishable by their slow NMR relaxation times.

The estimation of permeability of sedimentary formations is one of the most important factors in distinguishing economic from uneconomic reservoirs. However, in general, the estimation of permeability from log data has been only partially successful.

The present invention introduces an improved method of estimating the permeability of sedimentary rock formations. The current invention uses a k-Lambda permeability estimator developed by Herron (1996) and Herron et al (1997), wherein the Λ parameter is the size of dynamically connected pores.

Two equations are used for the k-Lambda estimate from the surface-to-pore volume ratio. The first is:

$$K_{\Lambda 1}=Z_{s1}\phi^{m^*}/(S/V_p)^2$$

where: $\phi$ is the porosity, $m^*$ is Archie's cementation exponent, $S/V_p$ is the surface-to-pore volume ratio, and $Z_{s1}$ is a constant.

This equation is used in estimates that are equal to, or greater than 100 millidarcies (md). For estimates below 100 md, a second k-Lambda equation is used:

$$K_{\Lambda 2}=Z_{s2}\phi^{1.7m^*}/(S/V_p)^{3.4}$$

where: $Z_{s2}$ is a second constant.

one of the forms of this estimator uses a logarithmic mean of the $T_1$ or $T_2$ distribution relaxation time. This time is dependent upon the presence of oil or water in the NMR-sensed pore space. The fraction of hydrocarbon in that pore space and the bulk $T_2$ of any hydrocarbon are not generally known in well logging. This adversity affects the log mean relaxation time estimate of permeability.

This invention reflects the discovery that the early time portion of the $T_1$ or $T_2$ distribution provides fundamental information necessary to calculate k-Lambda.

The early time portion of the distribution is not affected by the fluid in the larger pores, and is therefore insensitive to the presence of water or oil.

One of the important advantages of the inventive method is that the k-Lambda technique can be activated using log data. The NMR form of the k-Lambda method uses total porosity and magnetic resonance measurements, (relaxation time, $T_1$ or $T_2$) data.

Another important advantage of the method of this invention is that the k-Lambda technique with the short relaxation time $T_2$, is a robust means of estimating permeability, because it is insensitive to the presence of water or oil, as aforementioned.

SUMMARY OF THE INVENTION

In accordance with the present invention, there is provided a method of accurately estimating the permeability of sedimentary rock formations from well logging data. The method involves a short $T_2$ strategy with the identification of the key k-Lambda parameter $S/V_p$, which is the surface-to-pore volume ratio. The inverse of $T_2$ is related to this ratio by the surface relaxivity, ρ2. The $S/V_p$ estimator is given by:

$$\frac{S}{V_p}=\frac{1}{V_p}\sum_{i}^{n}\frac{\Delta V_i}{\rho_{2i}T_{2i}}$$

where: $\Delta V_i$ represents the ith volume element of the $T_2$ distribution and the sum over i=1 to n represents some set of early to later volume elements; and $V_p$ is the total pore volume.

It is an object of this invention to provide an improved method of estimating the permeability of sedimentary rock.

It is another object of the invention to provide a technique of determining permeability of sedimentary formations by using a short relaxation time strategy.

BRIEF DESCRIPTION OF THE DRAWINGS

A complete understanding of the present invention may be obtained by reference to the accompanying drawing, when considered in conjunction with the subsequent detailed description, in which the FIGURE illustrates a logarithmic graphic plot of measured permeability using the k-Lambda technique of this invention.

DESCRIPTION OF THE PREFERRED EMBODIMENT

Figure 1:
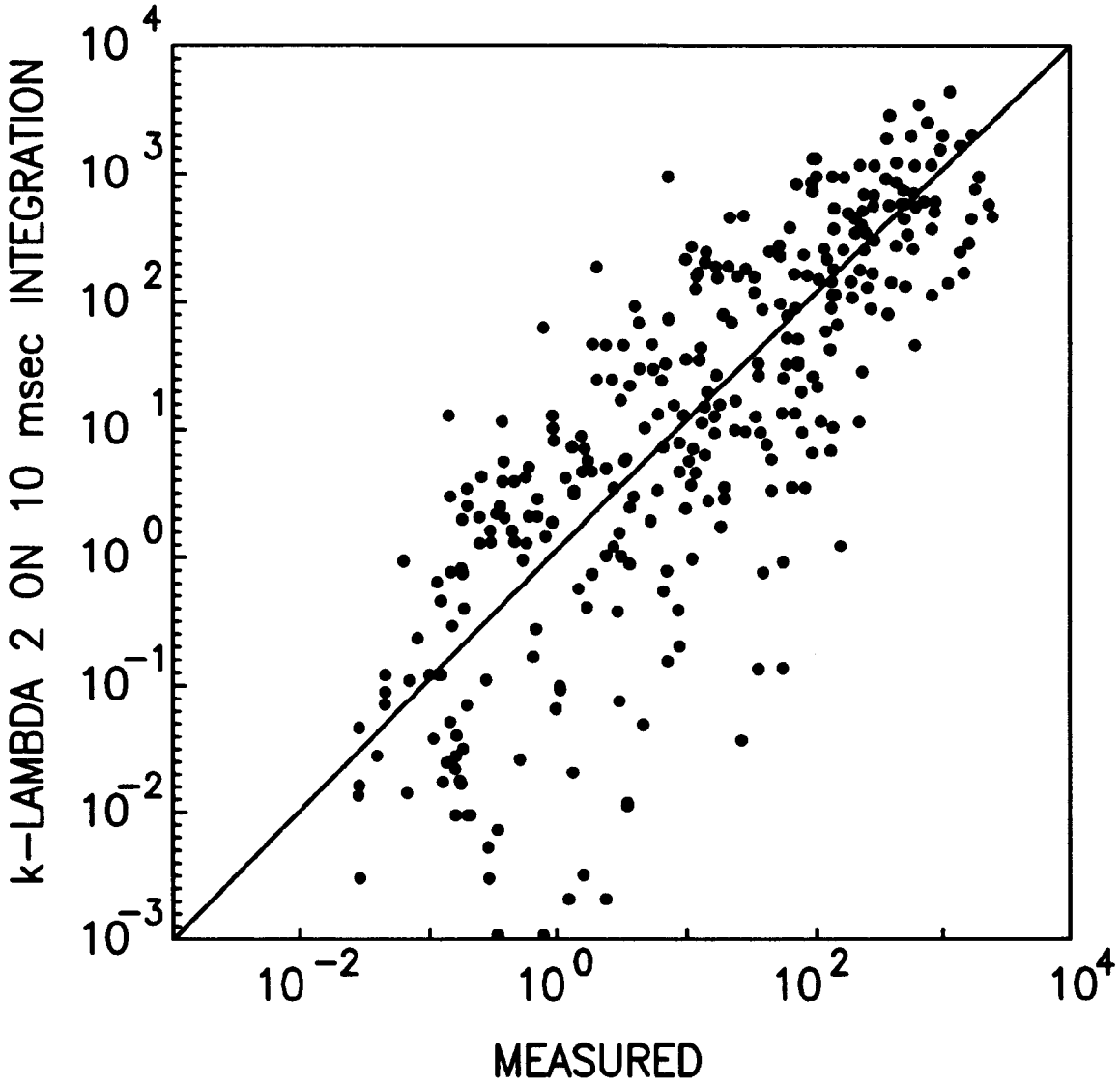

Generally speaking, the invention features a method of accurately estimating the permeability of sedimentary rock formations from well logging data. The method involves a short relaxation time strategy with the identification of the key k-Lambda parameter $S/V_p$, which is the surface-to-pore ratio.

The inverse of $T_2$ should be related to the surface-to-pore volume ratio through ρ2, the surface relaxivity, if the dominant relaxation mechanism is the surface relaxation.

The relationship is given by:

$$1/T_2=\rho_2 S/V_p$$

The relationship should hold for all values of the $T_2$ distribution (before or after diffusion correction). A similar relation holds for $T_1$. Because most of the surface area contribution in real rocks exists in the relatively short $T_2$ region, the surface-to-pore volume ratio can be approximated by summing the $1/T_2$ distribution according to the following equation:

$$\frac{S}{V_p} = \frac{1}{V_p}\sum_{i}^{n}\frac{\Delta V_i}{\rho_{2_i} T_{2_i}}$$

where: $\Delta V_i$ represents the ith volume element of the $T_2$ distribution and the sum over i=1 to n represents some set of early to later volume elements; and $V_p$ is the total pore volume.

In testing the above relationship, ρ2 was allowed to be a constant over the entire relationship; and the value of ρ2 for a number of laboratory sandstones was optimized.

Referring to the FIGURE, there is illustrated a comparison between the measured logarithm of permeability on a sandstone data set, with the logarithm of the estimate from the less-than-10 millisecond portion of the $T_2$ distribution.

The total porosity and m*, determined in the conventional way from the slope of the rock conductivity-brine conductivity plot, were measured independently on each core sample. The agreement between measured and estimated permeability demonstrates the efficacy of the inventive technique.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A method of estimating permeability of a rock formation using a lambda parameter, Λ, representing the size of dynamically connected pores in said rock formation, and nuclear magnetic resonance (NMR) relaxation time data, said method comprising the steps of:

a) obtaining NMR relaxation time data for a rock formation; and b) estimating the permeability of said rock formation from an alternate k-Lambda expression using a short relaxation time strategy.

2. The method in accordance with claim 1, wherein said alternative k-Lambda expression is represented by a general formula:

$$\frac{S}{V_p} = \frac{1}{V_p}\sum_{i}^{n}\frac{\Delta V_i}{\rho_{2_i} T_{2_i}}$$

where: $\Delta V_i$ represents volume elements of $T_2$ distribution and sum over i=1 to n represents some set of early to later volume elements;

$V_p$ is total pore volume;

$S/V_p$ is surface-to-pore ratio;

ρ2 is surface relaxivity; and the $T_2$ distribution is less-than-10 millisecond portion of the $T_2$ distribution.

* * * * *